US006815900B2

(12) United States Patent
Ahmad et al.

(10) Patent No.: US 6,815,900 B2
(45) Date of Patent: Nov. 9, 2004

(54) RADIATION SOURCE WITH HIGH AVERAGE EUV RADIATION OUTPUT

(75) Inventors: Imtiaz Ahmad, Goettingen (DE); Juergen Kleinschmidt, Weissenfels (DE); Guido Schriever, Goettingen (DE); Uwe Stamm, Goettingen (DE); Sven Goetze, Goettingen (DE)

(73) Assignee: Xtreme technologies GbmH, Jena (DE)

( * ) Notice: Subject to any disclaimer, the term of this patent is extended or adjusted under 35 U.S.C. 154(b) by 0 days.

(21) Appl. No.: 10/741,882

(22) Filed: Dec. 19, 2003

(65) Prior Publication Data

US 2004/0145292 A1 Jul. 29, 2004

(30) Foreign Application Priority Data

Dec. 19, 2002 (DE) ..... 102 60 458

(51) Int. Cl.[7] ..... H05H 1/00; H01J 17/26

(52) U.S. Cl. ..... 315/111.21; 315/111.71; 315/111.01; 313/231.31; 250/304 R; 250/365

(58) Field of Search ..... 315/111.21, 111.71, 315/111.01; 313/231.31; 250/504 R, 365

(56) References Cited

U.S. PATENT DOCUMENTS

2003/0190012 A1 * 10/2003 Ahmad ..... 378/119
2004/0135517 A1 * 7/2004 Schriever et al. ..... 315/111.21

FOREIGN PATENT DOCUMENTS

| | | |
|---|---|---|
| DE | 199 62 160 | 2/2001 |
| DE | 101 51 080 | 12/2002 |
| WO | WO 01/78469 | 10/2001 |
| WO | WO 02/082872 | 10/2002 |

* cited by examiner

*Primary Examiner*—Nikita Wells
(74) *Attorney, Agent, or Firm*—Reed Smith LLP

(57) ABSTRACT

The invention is directed to a radiation source for generating extreme ultraviolet (EUV) radiation based on a hot, dense plasma generated by gas discharge. The object of the invention, to find a novel possibility for the realization of an EUV radiation source which achieves a high average radiation output in the EUV region and sufficiently long life and long-term stability, is met according to the invention in that a first electrode housing and a second electrode housing which are electrically separated from one another so as to be resistant to breakdown form parts of a vacuum chamber for a gas discharge for plasma generation, and the second electrode housing has an electrode collar which is enclosed concentrically by the first electrode housing so that the gas discharge is oriented substantially only parallel to the axis of symmetry of the electrode housings, and the electrode collar is stepped radially relative to the concentric insulator layer in such a way that at least one end region of the electrode collar is at a distance from the concentric insulator layer such that a concentric gap is formed. A substantially longer operating duration is achieved by the optimized electrode geometry in conjunction with material selection and effective heat dissipation.

37 Claims, 8 Drawing Sheets

RADIATION SOURCE WITH HIGH AVERAGE EUV RADIATION OUTPUT

CROSS-REFERENCE TO RELATED APPLICATION

This application claims priority of German Application No. 102 60 458.4, filed Dec. 19, 2002, the complete disclosure of which is hereby incorporated by reference.

BACKGROUND OF THE INVENTION a) Field of the Invention

The invention is directed to a radiation source for generating extreme ultraviolet (EUV) radiation based on a hot, dense plasma generated by gas discharge, particularly for generating high average EUV radiation outputs.

b) Description of the Related Art

In the last 35 years, semiconductor chip producers have achieved considerable growth rates and increases in output by continuously reducing transistor sizes from the micrometer range to the nanometer range. Since its formulation in 1965, Moore's law has been steadily corroborated in the semiconductor lithography industry by a gradual reduction of the wavelength in the utilized radiation. At present, the industry is making the transition from the ArF excimer laser with a wavelength of $\lambda$=193 nm to the $F_2$ laser with a wavelength of $\lambda$=157 nm. There is a conviction that because of the transmission limits of lens systems radiation at $\lambda$=157 nm will be the smallest radiation ever used in semiconductor lithography which utilizes transmission optics or catadioptric systems.

However, the increase in the operating speed of a microprocessor predicted for the end of this decade by Moore's law could stagnate if the resolution limit of exposure equipment given by $R \sim \lambda/NA$ for a resolvable structure spacing R is reached. This equation shows that the structure resolution can only be improved by reducing the wavelength $\lambda$ and/or increasing the numerical aperture NA of the optics. Since the theoretical limit of the numerical aperture NA is 1 and the industry already uses values up to NA=0.8, the sole possibility for reducing the resolution limit and, therefore, further reducing transistor size is a further reduction in wavelength.

Therefore, it can be stated at the present time that a further substantial increase in the numerical aperture of optics is impossible and that no transmission optics or catadioptric system permits the use of wavelengths substantially smaller than 157 nm. Accordingly, there was reason to fear that the development predicted by Moore's law would stagnate in coming years if no alternative possibilities were found for overcoming the problem. Fortunately, the development of multilayer mirrors with a 70-% reflection factor in the range of 10 to 15 nm offered the semiconductor industry a new prospect for the use of EUV radiation in this wavelength range and accordingly provided new hope that current lithographic chip fabrication will remain for another decade as dynamic as it has been thus far.

Although radiation sources based on plasma generated by gas discharge as well as laser-generated plasmas have shown adequate potential to emit EUV radiation in the desired wavelength range of 10 to 15 nm, these sources are still far from being used as commercial high-output radiation sources such as are required in chip fabrication for exposure machines with output powers of several hundred watts. With the greatest possible conversion efficiency that can be achieved for a plasma generated by gas discharge estimated at about $1\%/2\pi \cdot sr$, an input power of 20 kW would be required to collect 100-watt EUV radiation in a solid angle of $\pi$sr. Further, it must be kept in mind that the majority of this enormous power for converting into plasma must be transmitted over discharge surfaces of a few square centimeters. It can easily be imagined that these small surfaces will not be stable over a long duration, so that radiation sources based on a gas discharge appear unsuitable for stable long-term use due to the fact that they must work in continuous operation for upwards of at least twenty hours and more at repetition frequencies of between 2 and 10 kHz for commercial use in chip lithography.

OBJECT AND SUMMARY OF THE INVENTION

Therefore, it is the primary object of the invention to find a novel possibility for the realization of an EUV radiation source which achieves a high average radiation output in the EUV region and remains stable for a sufficiently long period of time.

According to the invention, in a radiation source for the generation of extreme ultraviolet (EUV) radiation based on a dense, hot plasma generated by gas discharge containing two electrodes which are electrically separated from one another by insulators which are resistant to breakdown and at the same time form rotationally symmetric electrode housings for parts of a vacuum chamber, wherein a gas discharge for plasma generation is provided between a first electrode housing and a second electrode housing within the vacuum chamber and an exit or outlet opening for the radiation emitted by the plasma is provided in the first electrode housing, further containing a gas supply unit for generating a flow of working gas through the vacuum chamber, a high-voltage module for providing high-voltage pulses at the electrodes and a preionization unit for generating preionization of the working gas prior to the gas discharge triggered by the high-voltage pulse, the above-stated object is met, according to the invention, in that the second electrode housing has a narrowed portion and an electrode collar which adjoins the latter and which is enclosed concentrically by the first electrode housing, wherein a concentric insulator layer is provided in this area of concentric overlapping between the first electrode housing and the electrode collar of the second electrode housing in order to shield the concentric surface regions of the two electrode housings, which concentric insulator layer extends in the direction of the outlet opening of the first electrode such that the gas discharge takes place substantially only parallel to the axis of symmetry of the electrode housing, and the electrode collar is stepped radially relative to the concentric insulator layer in such a way that at least one end region of the electrode collar is at a distance from the concentric insulator layer such that a concentric gap is formed.

The outlet opening in the first electrode housing advantageously has the shape of a circular narrowed portion coaxial to the axis of symmetry of the electrode housing and the first electrode housing is expanded conically following the narrowed outlet opening, so that the gas discharge is ignited between the two electrodes in the interior of the first electrode housing and the dense, hot plasma is formed within the conical expansion after the outlet opening of the first electrode housing.

For purposes of suitable orientation of the gas discharge in the interior of the first electrode housing, the electrode collar of the second electrode housing projecting into the first electrode housing preferably has the shape of a hollow cylinder with a plurality of steps.

In this connection, it can be advantageous that the electrode collar is a hollow cylinder with two outer and one inner step, wherein the second outer step forms a transition from the electrode collar to the base body of the second electrode housing. Further, it is useful when at least one of the steps of the hollow cylinder has a conical transition in order to improve heat dissipation and the stability of the electrode collar relative to the base body of the second electrode housing.

The base body of the electrode housing is advantageously produced from one of the metals, copper, tungsten, molybdenum or a tungsten-copper alloy in a desired mixture ratio, wherein at least highly loaded zones of the electrode collar of the second electrode housing are produced from an alloy of tungsten with one of the materials, titanium, tantalum, zirconium, rhenium, lanthanum, lanthanum oxide, nickel, iron, nickel-iron compounds or zirconium-oxygen compounds in a desired mixture ratio, or the highly loaded zones comprise an alloy of molybdenum with one of the materials, titanium, tantalum, zirconium, rhenium, lanthanum, lanthanum oxide, nickel, iron, nickel-iron compounds or zirconium-oxygen compounds in a desired mixture ratio.

Zones of the electrode housing upon which the radiation flow acts particularly intensively, particularly free inner edges of the electrode collar or of the outlet opening, are coated, in addition, with a material having a low sputter rate. Coatings with aluminum oxide, aluminum nitride, zirconium oxides or silicon oxides are particularly suitable for this purpose.

Another advisable possibility for reducing electrode wear consists in coating highly loaded zones of the electrode housing, particularly the electrode collar or the outlet opening, with an alloy of tungsten, molybdenum or rhenium with one of the compounds aluminum nitride, aluminum oxide, zirconium oxide or silicon oxide. Further, coating these highly loaded electrode zones with a tungsten-carbon compound, preferably a tungsten-diamond compound, has proven particularly suitable.

It is advisable for the operation of the radiation source that the first electrode housing is arranged as anode and the second electrode housing is arranged as cathode for the high-voltage gas discharge. In another preferred variant, the first electrode housing is arranged as cathode and the second electrode housing is arranged as anode.

In order to prolong the life of the electrodes, it is further advisable when the first electrode housing and the second electrode housing are fashioned in such a way that they have a base body comprising material with very good thermal conduction, particularly copper, wherein an efficient heat dissipation system is joined to this base body for efficient elimination of heat from the discharge zone of the electrodes.

The heat dissipation system is preferably based upon a porous metal structure through which coolant is pumped under high pressure or upon a heat pipe system. In either case, water, a low-viscosity oil, e.g., Galden, mercury, sodium or lithium, can be used as active coolant.

It proves advantageous when a heat dissipation system of the type mentioned above is integrated in the base body of each electrode housing. However, it can also be arranged externally so that it is possible to exchange the electrode housings and heat dissipation system separately.

The concentric insulator in the interior of the first electrode housing which is provided for shielding the side walls of the first electrode housing from the electrode collar of the second electrode housing is advisably produced as an insulator pipe from one of the compounds, $Si_3N_4$, $Al_2O_3$, AlN, AlZr, AlTi, BeO or lead-zirconium-titanate (PZT).

The preionization module is advantageously arranged coaxially inside the second electrode housing and comprises two circular electrodes with a rod-shaped insulator located therebetween, wherein an end surface of the second electrode housing is advisably used as one of the circular electrodes and the surface of the rod-shaped insulator is provided for a sliding discharge for preionization of the working gas. In this connection, the rod-shaped insulator is preferably made of one of the materials, $Si_3N_4$, $Al_2O_3$, AlN, AlZr, AlTi, BeO, or of highly dielectric materials such as lead-zirconium-titanate (PZT), barium titanate, strontium titanate, lead borosilicate or lead-zinc borosilicate.

At the same time, the preionization module can have a gas inlet for the working gas, this gas inlet being guided coaxially through the rod-shaped insulator. Another advantageous way to supply the working gas consists in that a gas inlet with inlet openings that are evenly distributed with respect to the axis of symmetry is arranged in the conical expansion of the first electrode housing.

One of the gases, xenon, krypton, argon, neon, nitrogen, oxygen or lithium, or a mixture of some of the latter can be used as working gas. Xenon in a desired mixture ratio with one of the gases, hydrogen, deuterium, helium or neon, has proven to be a particularly suitable working gas.

In order to achieve sufficiently high average output power of the radiation source, the high-voltage module advisably contains a pulse generator with a repetition frequency between 1 Hz and 20 kHz for igniting the gas discharge and generating a dense, hot plasma.

In a radiation source for generating extreme ultraviolet (EUV) radiation based on a dense, hot plasma generated by gas discharge, preferably using hollow cathode triggered pinch arrangements, theta pinch arrangements, plasma focus arrangements or astron arrangements, containing two electrodes which are electrically separated and which at the same time form rotationally symmetric electrode housings for parts of a vacuum chamber, wherein a gas discharge for plasma generation is provided between the electrode housings inside the vacuum chamber, and an outlet opening for the radiation emitted by the plasma is provided in at least a first electrode housing, a gas supply unit for generating a flow of working gas through the vacuum chamber, a high-voltage module for providing high-voltage pulses to the electrodes, the above-stated object is further met, according to the invention, in that a second electrode housing likewise has a narrowed portion which is coaxially received by the first electrode housing, and each of the electrode housings comprises a base body with very good heat conduction which is connected to an efficient heat dissipation system and electrode zones subject to high thermal loading comprise materials with a high melting point at least at the narrowed portions of the electrode housings.

The first electrode housing is advantageously coated with an insulator layer at the inner surfaces coaxially adjoining (in an electrically insulated manner) the narrowed portion of the second electrode housing, so that the gas discharge is oriented essentially only parallel to the axis of symmetry of the electrode housings.

Further, it has proven particularly advisable when the outlet opening of the first electrode housing is a circular narrowed portion coaxial to the axis of symmetry of the electrode housing and the electrode housing is expanded conically after the outlet opening, so that the gas discharge between the two electrodes is ignited and the dense, hot plasma is formed inside the conical expansion after the outlet opening of the first electrode housing.

The highly loaded electrode zones preferably comprise tungsten or molybdenum or an alloy of tungsten or molybdenum with one of the materials, titanium, tantalum, zirconium, rhenium, lanthanum, lanthanum oxide, nickel, iron, nickel-iron compounds or zirconium-oxygen compounds in a desired mixture ratio.

In order to protect especially highly loaded parts of the electrode housings that are exposed to the radiation flow emitted from the plasma, the inner edges of the electrodes in particular are advantageously coated with materials having low sputter rates such as aluminum oxide, aluminum nitride, zirconium oxides, silicon oxides or an alloy of one of these compounds with tungsten, molybdenum or rhenium. Another possibility for protecting against erosion of parts of the electrode housing that are especially loaded by radiation consists in that the inner edges of the electrodes are coated with tungsten-carbon compounds, particularly with a tungsten-diamond compound.

The heat dissipation system connected to the electrode housings preferably contains a porous metal structure or heat pipe system in the base body.

In an electrode configuration in which at least a substantial portion of an electrode lies within an external electrode housing, the heat dissipation system has cooling channels for the inner electrode, wherein the cooling channels through the outer electrode housing are provided for cooling the inner electrode based on a porous metal structure or a heat pipe system.

The basic idea of the invention is founded on the consideration that present EUV radiation sources based on a gas discharge plasma can not meet the exacting requirements of lithography exposure devices for the semiconductor industry above all because enormous electrode wear apparently makes long term use impossible. On the one hand, the electrodes are exposed to considerable thermal loading and, further, are subject to an embrittlement effect through the intense radiation from the generated plasma which contains not only the desired EUV light, but also hard x-ray radiation and matter in the form of neutral particles and charged particles. On the other hand, the shape of the vacuum chamber and the electrode configuration located therein cause additional effects which lead to malfunctions even after brief use in continuous operation due to metallization of insulator surfaces. According to the invention, these unwanted effects are countered in that the active electrode zones are designed in such a way that a directed gas discharge is ignited in a defined manner and metallization of the insulator surfaces is extensively prevented. By means of further suitable shaping of an electrode housing, the location of the generated dense plasma is relocated from the actual gas discharge area to behind the termination of the discharge zone of the vacuum chamber provided as conventional outlet opening. Additional measures involve the choice of material of the base body of the electrodes and the highly loaded electrode zones and a coating of the inner surfaces of the electrodes for reducing sputter of electrode surfaces (common cathode sputter as well as sputter due to radiation-induced surface embrittlement). Another focal point for reducing electrode wear is the arrangements for effective cooling of the electrodes by means of porous metal structures or heat pipe systems (e.g., with porous tungsten-lithium heating pipes) in order to draw off heat loading of multiple $kW/cm^2$.

With the radiation source according to the invention it is possible to achieve a stable plasma generation for emission of EUV radiation through reduction of electrode wear and other effects (e.g., metallization of insulator surfaces) impairing the discharge behavior in the vacuum chamber, a high average radiation output in the EUV range, and long-term stability of sufficient extent.

The invention will be described more fully in the following with reference to embodiment examples.

DESCRIPTION OF THE PREFERRED EMBODIMENTS

Figure 1:
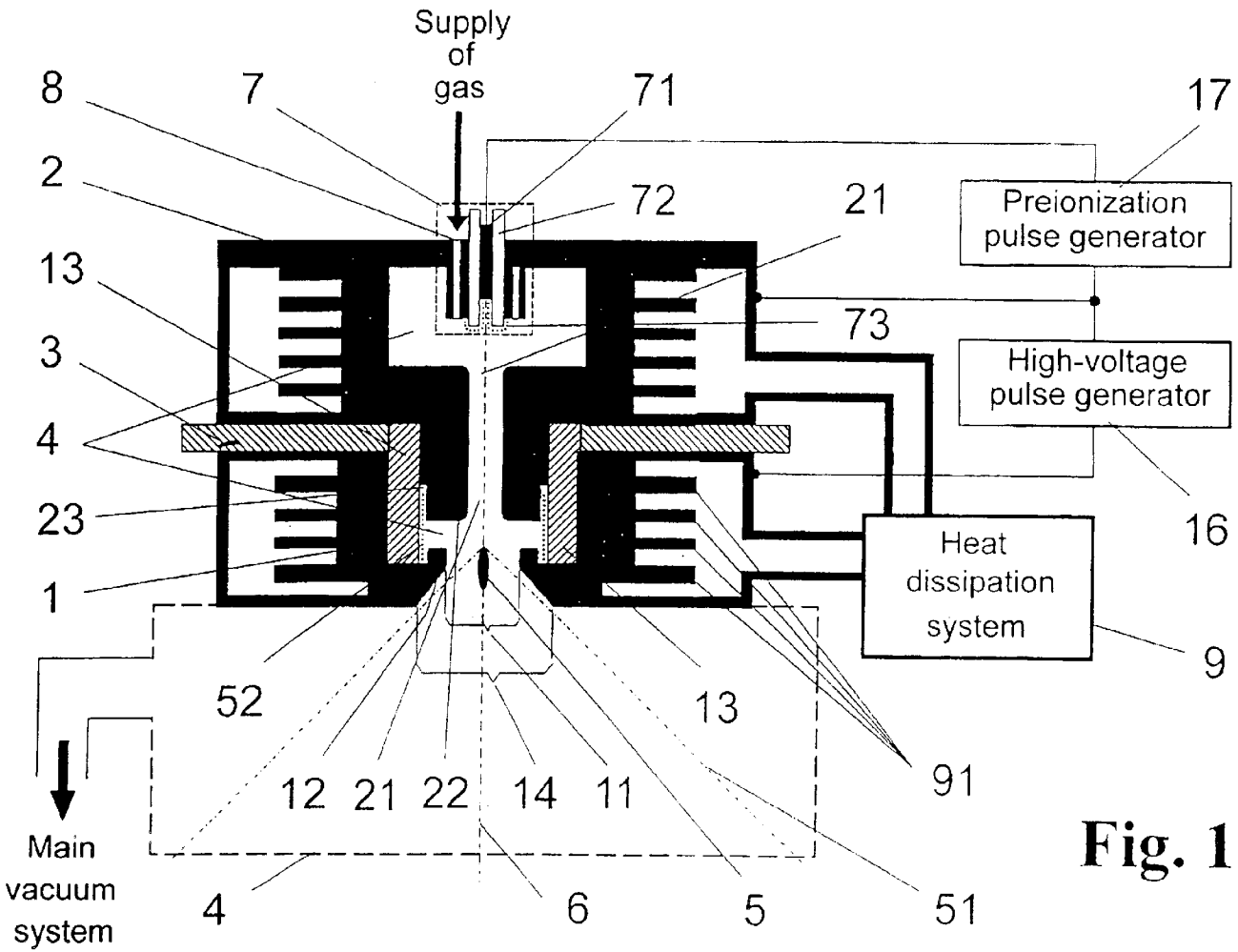
FIG. 1 is a sectional view of the radiation source according to the invention with two electrode housings, wherein the gas discharge takes place in the first electrode housing and a preionization takes place in the second electrode housing.

In its basic construction, as is shown in FIG. 1, the EUV source according to the invention comprises a first electrode housing 1 and a second electrode housing 2 which are insulated from one another against high voltage by an insulator 3 which is arranged in such a way that an unwanted discharge between the electrode housings 1 and 2 is prevented. Each of the electrode housings 1 and 2 has a rotationally symmetric cavity and together form a vacuum chamber 4 through which a working gas flows and in which a gas discharge occurs for generating a dense, hot plasma 5. The narrowed outlet of the first electrode housing 1 forms the outlet opening 11 for the EUV radiation 51 generated from the plasma 5.

In the interior of the first electrode housing 1, active parts of the electrode housings 1 and 2 are located opposite one another in the form of concentric electrodes 12 and 22, between which the gas discharge is triggered (ignited). A tubular insulator layer 13 of suitable diameter and suitable length is inserted concentrically and fixedly in the first electrode housing 1 and shields the inner side surfaces relative to the electrode 22 of the second electrode housing 2, so that the initial gas discharge 52 occurs only between the electrode 22 and the housing wall of the first electrode housing 1 provided with the outlet opening 11.

A preionization module 7 is arranged inside the second electrode housing 2 in order to facilitate the ignition of the gas discharge by partial ionization of the working gas. The preionization module 7 comprises a coaxial electrode geometry which is formed by an end surface or end face of the second electrode housing 2 and an additional central electrode 71 which is enclosed in the interior of the ceramic tube 72. A sliding discharge 73 takes place along the surfaces of the ceramic tube 72 by applying a (pulsed) voltage which causes the preionization of the working gas. The voltage for the preionization is provided by a preionization pulse generator 17 which is connected to the second electrode housing 2 and the central electrode 71. At the same time, a gas inlet 8 is provided in the preionization module 7 for supplying the working gas, which gas inlet 8 advisably distributes the working gas uniformly around the axis of symmetry 6.

Figure 2:
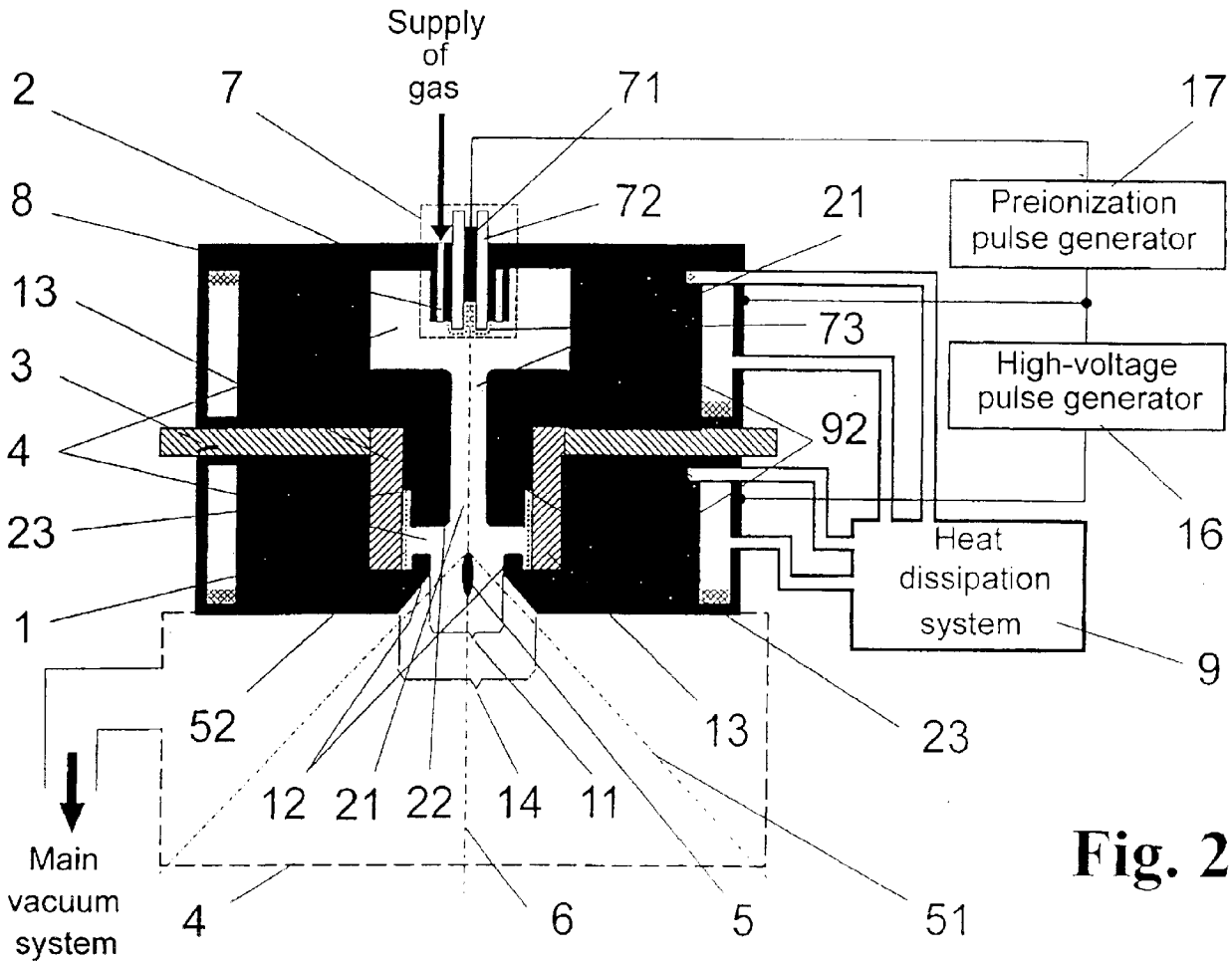
FIG. 2 shows a cross section as in FIG. 1, but with the difference that a porous material is used for cooling.

According to FIG. 2, the electrode 12 is an integral component part of the first electrode housing 1 and—due to the rest of the inner surfaces being covered by the insulator layer 13— is a ring electrode. The outlet opening 11 for the EUV radiation 51 lies in the center of this ring-shaped electrode 12. The space between the ring-shaped electrode 12 and the narrowed outlet 21 of the second electrode housing 2 is the actual gas discharge zone.

The outlet 21 of the second electrode housing 2 is a specially shaped part in the form of a hollow cylinder which is arranged concentric to the two electrode housings 1 and 2 and which projects out of the second electrode housing 2 into the interior of the first electrode housing 1 and is therefore referred to hereinafter as the electrode collar 22. The electrode collar 22 lies substantially close to the insulator layer 13 covering the first electrode housing 1. It is stepped radially at its end by a reduction in its outer circumference, so that an annular gap-shaped space is formed relative to the tubular insulator layer 13. The initial gas discharge 52 accordingly does not take place directly at the surface of the insulator layer 13 and a metallization of the insulator surface such as occurs when there is direct contact with the insulator layer 13 and the electrode collar 22 due to electrode sputter is appreciably prevented. A similar shaping of a gap relative to the insulator layer 13 is also provided at the oppositely located electrode 12 of the first electrode housing 1. In addition, the ring-shaped electrode 12 which encloses the outlet opening 11 expands outward conically. This conical expansion 14 is a solid continuation of the ring-shaped electrode 12 outside the gas discharge zone which is located in the interior of the first electrode housing 1 and causes the plasma 5 imploding from the initial gas discharge 52 to be displaced from the outlet opening 11 outward into the conical expansion 14 of the first electrode housing 1. The radiation loading of the active areas of the ring-shaped electrode 12 and of the electrode collar 22 is reduced appreciably in this way.

The electrode housings 1 and 2 are connected to a high-voltage pulse generator 16 which is provided for generating high-voltage pulses at a repetition rate between 1 Hz and 20 kHz. The high-voltage pulse generator 16 comprises a thyratron or a semiconductor circuit (thyristor, IGBT, for example) with one-stage or multiple-stage magnetic compression modules. The size of every individual pulse is sufficient to generate a plasma 5 which emits the desired EUV radiation 51.

In FIG. 1, the working gas enters through the gas inlet 8 located in the preionization module 7. A gas control unit (not shown) maintains the pressure of the working gas at a desired level which allows an optimal through-flow rate of the working gas. A preionization pulse is triggered between the second electrode housing 2 and the central electrode 71 by a preionization pulse generator 17 which is capable of generating pulses with a voltage rise rate of up to $10^{11}$ V/s and whose voltage is high enough to generate a surface sliding discharge 73. The preionization discharge 73 simultaneously generates radiation from the visible spectral range to the x-ray range and fast electrons/ions which generate ionization in the space within the electrode collar 22 up to the ring-shaped electrode 12 in the first electrode housing 1. A few microseconds after the preionization pulse, the high-voltage pulse for the main discharge is ignited, which ignites the initial gas discharge 52 between the electrode collar 22 and the ring-shaped electrode 12. The sliding discharge 73 for preionization ensures the triggering of a uniformly oriented main discharge between the electrode collar 22 and the ring-shaped electrode 12. The substantial advantage of the preionization module 7 shown herein is that it is not directly exposed by the plasma 5 of the main discharge and therefore achieves a long operating life. The maximum discharge current flowing through the gas discharge zone in the interior of the first electrode housing 1 ranges between 10 kA and 60 kA depending on the discharge voltage and other discharge conditions and has a pulse duration of 200 to 500 ns. Due to the J×B force and the ohmic heating, a dense, hot plasma column with a length of 0.5 to 8 mm and a diameter of 0.3 to 2 mm is generated in the area of the outlet opening 11. The ignition of the gas discharge was tested with different materials for the tubular insulator layer 13, including AlN, $Al_2O_3$ and $Si_3N_4$; the first two compounds have not proven as stable, while $Si_3N_4$ with selected electrode shapes has withstood continuous operation with more than $10^8$ pulses.

A reduced outer diameter at the end of the electrode collar 22, i.e., a stepped portion 23, has proven very useful for a long operating duration of the radiation source. The electrode step 23 has a length of 5 to 15 mm and a depth of 0.5 to 1 mm. It has been observed that the radiation source only functions for a short time without the step 23. The main reason for this is that the ceramic insulator layer 13 is contaminated by the electrode erosion due to metallic material deposition on its surface and its surface becomes conductive after a few million pulses. Without the electrode step 23, excessive contamination on the surface of the insulator layer 13 causes a short circuit between the electrode collar 22 and ring-shaped electrode 12 after a few million pulses in continuous operation. Accordingly, a portion of the current flowing during the high-voltage pulse flows off over the surface of the insulator layer 13 between the electrode collar 22 and the ring-shaped electrode 12. This unwanted current flow reduces the current available for the formation of the actual plasma 5. When a stepped electrode portion 23 is present, there can be no direct electrical contact between the electrode collar 22 and ring-shaped electrode 12, so that the possibility of current splitting is much lower than in the former case.

The electrodes housings 1 and 2 are produced so as to enable a continuous through-flow of cooling liquid through its outer part in order to keep the temperature of the electrodes 12 and 22 at the lowest possible level. In the first example according to FIG. 1, deep grooves in which coolant circulates are introduced in the base body of the electrode housings 1 and 2, so that the base bodies of the electrodes 12 and 22 have ribs 91 for heat transfer and heat dissipation through the heat dissipation system 9 in order to transfer the greatest possible amount of heat. The coolant is preferably water or a low-viscosity oil such as Galden.

In the construction shown in FIG. 1, it is assumed—without limiting generality—that the first electrode housing 1 is connected as anode and the second electrode housing 2 is connected as cathode. However, switching the polarity results in the same process flow and sometimes even in greater yields of EUV radiation.

Since an input power of 20 kW is required for achieving 100 watts of output power of EUV radiation and the effective discharge zone is in the range of a few $cm^2$ in most conventional arrangements, a high thermal loading of multiple $kW/cm^2$ must be conducted away from the electrode surfaces. Various methods of heat dissipation are possible in order to solve this problem.

In this connection, FIG. 2 shows a construction which provides electrode cooling by means of porous metal in order to carry off heat of 10 $kW/cm^2$ from the electrode periphery. The principle of the heat exchanger of porous metal consists in that a porous structure 92 inside a metal sleeve acts as an enlarged surface and accordingly dissipates heat quickly in a circulating liquid.

Figure 3:
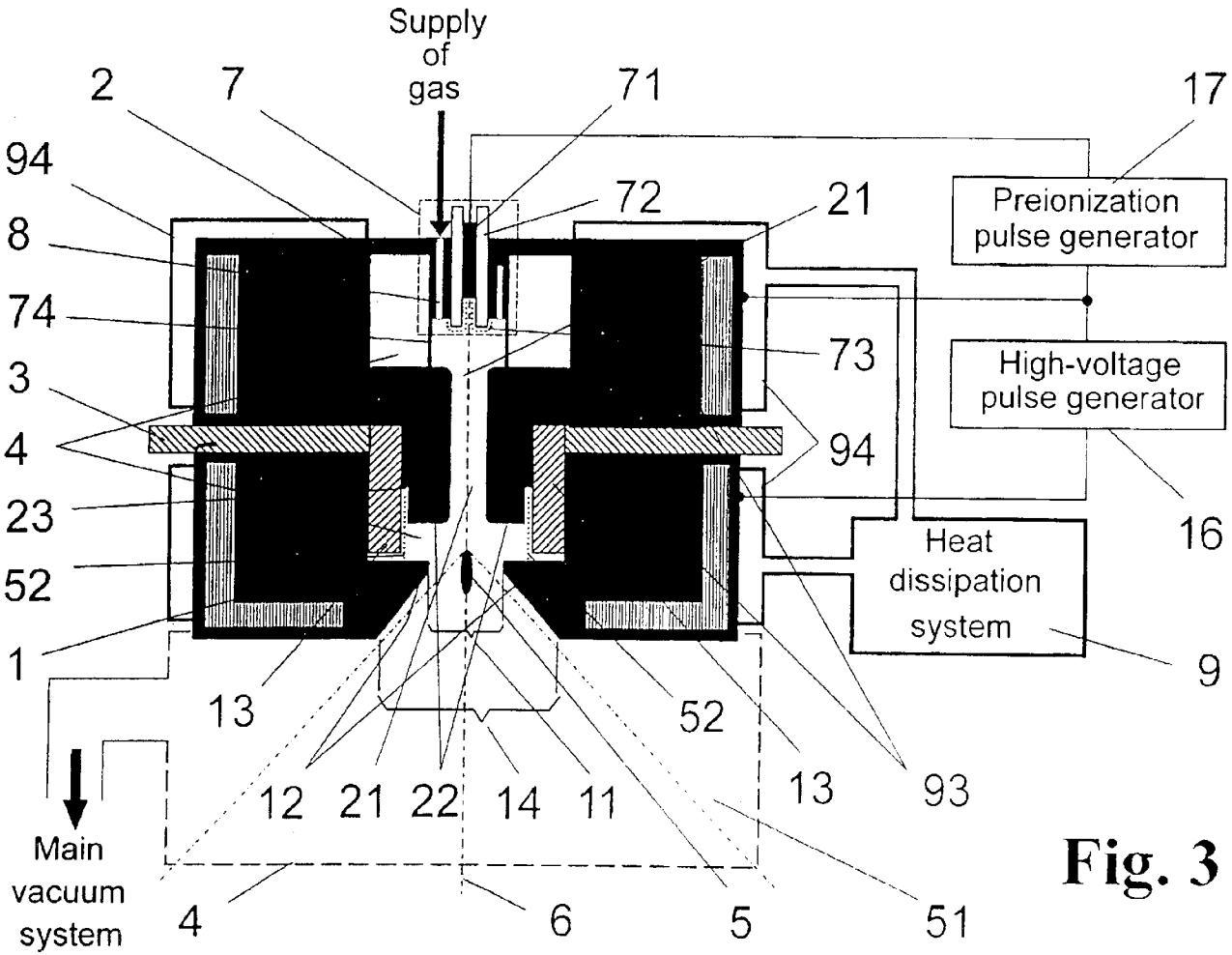
FIG. 3 shows a preferred arrangement of the EUV source in which a cooling system based on a heat pipe technique is provided.

In another variant according to FIG. 3, the respective base body of the electrode housings 1 and 2 has, in a cooling pipe, a bundle of a capillary structure 93 containing liquid (or a solid which liquefies in a determined state) in its interior which can enter into the pores of the capillary structure 93. The supply of a determined quantity of heat heats the liquid so that it passes into the gaseous state. The liquid accordingly receives, in addition, the latent evaporation heat and the resulting gas which is then under high pressure, moves within a closed vessel to an external colder part, where it condenses, and moves back as liquid to the hotter region and repeats the cycle. Because of their capacity to transfer heat rapidly from one zone to another, heat pipe systems are also called thermal superconductors. A conventional heat exchanger 94 which realizes the same cooling power over a larger surface is connected to the outer walls of the electrode housings 1 and 2 for the condensation of the evaporated cooling liquid. Similar steps (not shown) can also be taken for the preionization module 7 to keep the loaded surface at a low temperature. Further, a cylindrical supporting frame 74 is arranged between the preionization module 7 and the thermally highly loaded electrode collar 22, which supporting frame 74 presses the electrode into the second electrode housing to produce better thermal and electrical contact.

Further, for improved and automated cooling and to prevent melting, highly loaded zones of the electrode collar 22 and ring-shaped electrode 12 are produced from special alloys having a very high melting point and/or a low sputter rate.

For the arrangements of the EUV radiation source described above, these special electrode zones 24, which are shown in FIGS. 5*a*, 5*b*, 6*a*, 6*b*, 7 and 8 in various shapes for the electrode collar 22, comprise molybdenum, tungsten and a tungsten-copper alloy and are pressed into a base body 25 of copper. Electrodes 12 and 22 of this type have shown satisfactory results up to 9 kW average input power for several hours of continuous operation. Further, materials considered for the special electrode zones 24 also include alloys of tungsten or molybdenum with one of the materials, titanium, tantalum, zirconium, rhenium, lanthanum, lanthanum oxide, nickel, iron, nickel-iron compounds or zirconium-oxygen compounds as well as ceramic-metal compounds (e.g., ceramet).

Even better results are obtained when the special electrode zones 24 are embedded at the outer edge of the base body 25 by the process of back-casting, in which a second metal (or an alloy) is cast behind a prefabricated molded article. In this production process for the electrode zones 24 which are exposed to very high loading through the gas discharge, the special electrode zones 24 are preferably first produced as molded articles from the metals or alloys mentioned above having a high melting point, high thermal conductivity and low sputter rate. These special electrode parts 24 are then embedded in molten copper or any other metal with good heat conducting properties. A great advantage of this method is that the special electrode zones 24 are in active contact with the base body 25 and therefore allow a higher flow of heat. The special electrode parts 24 can comprise pure molybdenum, tungsten, alloys thereof, or an alloy of these metals through addition of copper, titanium, tantalum, niobium, zirconium, lanthanum, nickel, iron or lanthanum oxide or nickel-iron compounds which are to be added in a ratio of a few ppm (parts per million) up to a few percent to the principal metal (tungsten or molybdenum). Metals such as nickel, iron or nickel-iron compounds are provided to capture macroscopic debris particles through the action of the magnetic field (due to the high gas discharge flow).

Figure 7:
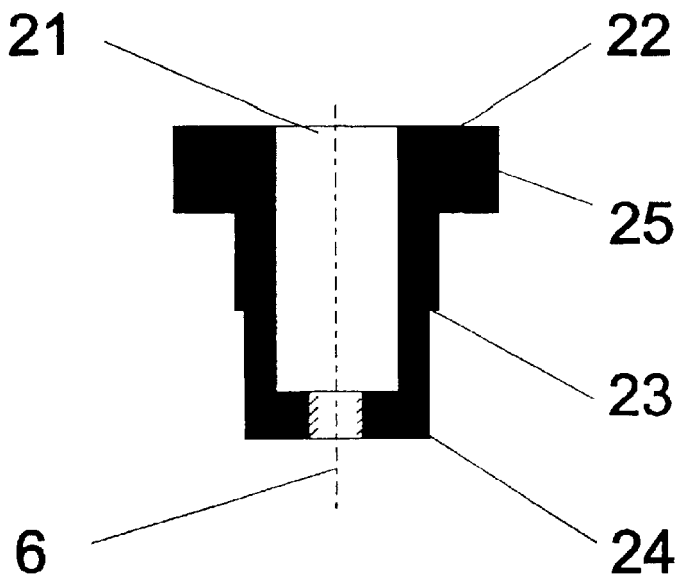
FIG. 7 shows another shape of the electrode collar with large inner diameter and narrowed end comprising material with a high melting point.
Figure 8:
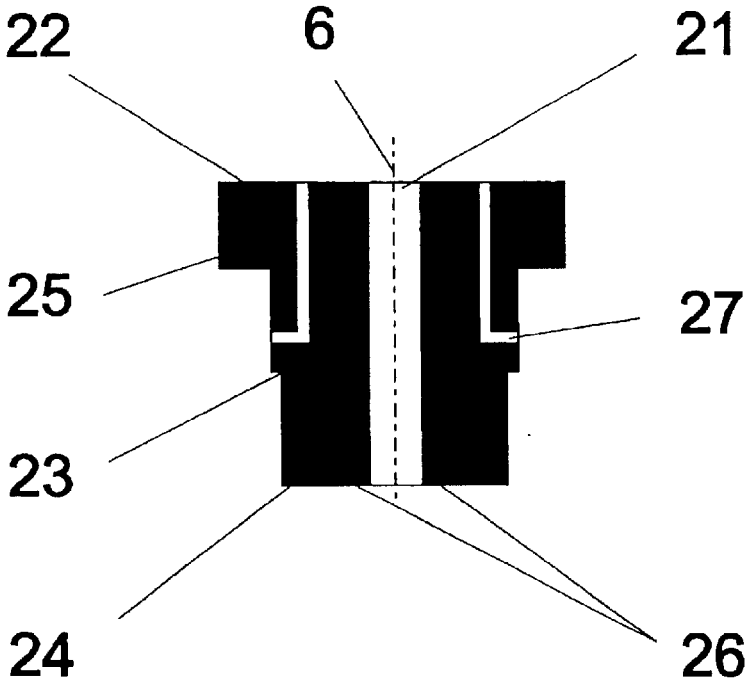
FIG. 8 shows an advantageous shape of the electrode collar with a small inner diameter and channels arranged in a circular shape around the latter in the highly heat-conducting base body which is coated in highly stressed zones with material having a high melting point and additionally with a low-sputter layer.

In all of the electrode constructions according to FIGS. 5 and 8, the active part of the electrode housings 1 and 2, namely, the ring-shaped electrode 12 participating in the gas discharge in the interior of the first electrode housing 1 and the electrode collar 22, are rotationally symmetric hollow bodies which are cylindrical or conical. They may differ in length, outer diameter, electrode stepping 23 or inner diameter and are indicated in the above-mentioned FIGS. 5 to 8, for example, for the electrode collar 22 which constitutes the outlet 21 of the second electrode housing 2 acting as preionization chamber.

Figures 5A, 5B:
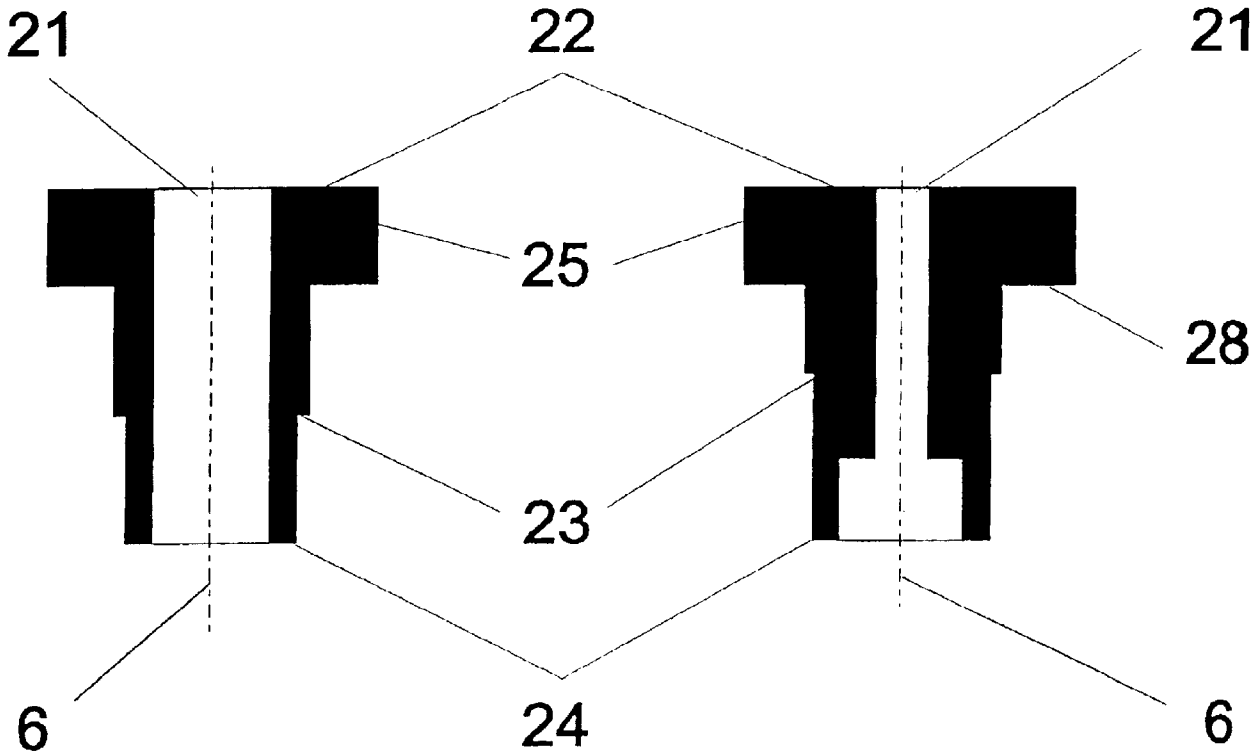
FIGS. 5*a*, 5*b* show two preferred shapes of the electrode collar with stepped electrode portions, wherein the base body of the electrodes is produced from highly heat-conducting material and very highly loaded parts of the electrodes are coated by material with a high melting point.

FIG. 5*a* shows a basic shape of the electrode collar 22 whose base body 25 passes into the electrode housing 2 (not shown in more detail in this drawing) at the point of the greatest outer diameter. The stepped portion 23 of the outer diameter in the area of the end of the electrode collar 22 is clearly visible. In addition, the inner edges which are at risk of consumption or bumup and the end surfaces are constructed as special electrode parts from a material with the above-mentioned composition having a higher melting point than the base body 25. In case of a smaller inner diameter of the outlet 21 of the second electrode housing 2 as transition to the first electrode housing 1 (see FIGS. 1 to 3), FIG. 5*b* shows a measure for preventing the closure of the outlet 21 in the end area of the electrode collar 22 in that the inner diameter has a stepped portion which otherwise, as in FIG. 5*a*, is completely coated by material with a high melting point.

Figures 6A, 6B:
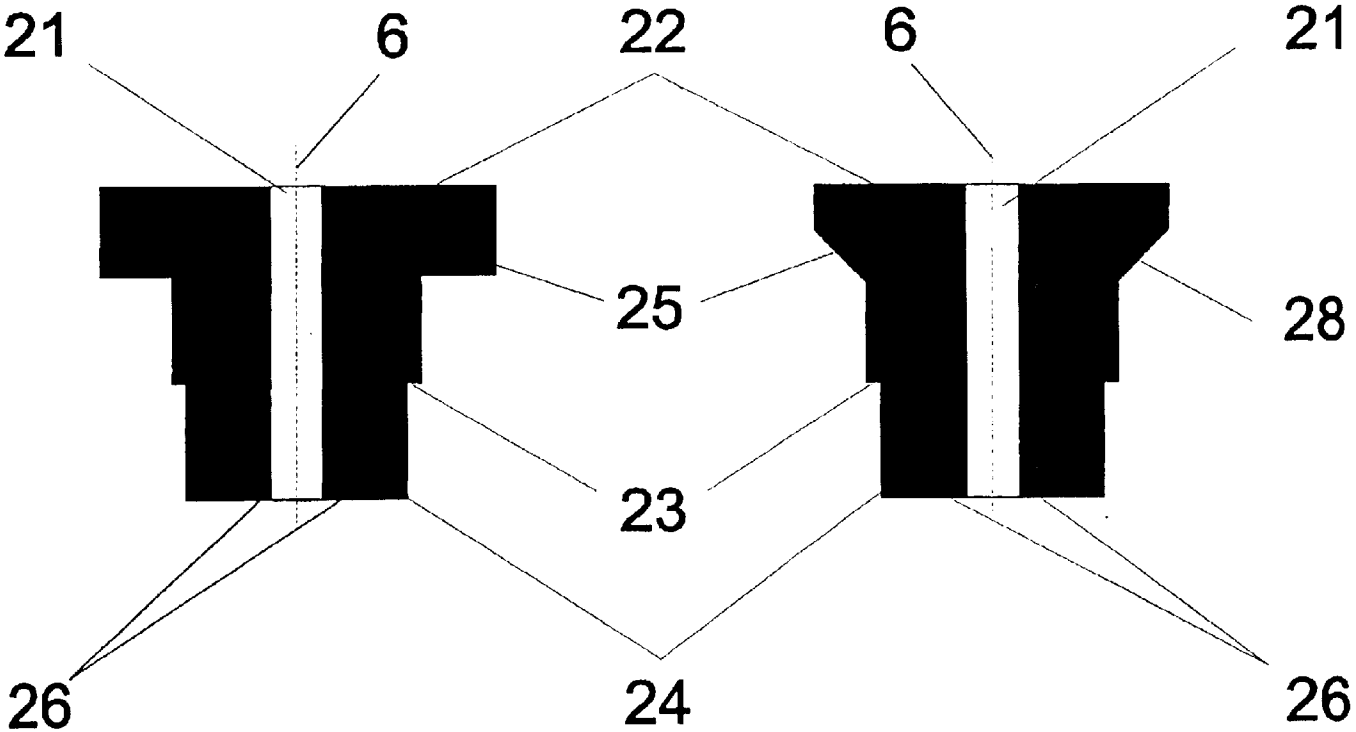
FIG. 6*a* shows two preferred shapes of the electrode collar with stepped electrode portions of the highly heat-conducting base body, wherein highly loaded electrode parts comprise material with a high melting point and, in addition, are coated with material with a low sputter rate.
FIG. 6*b*, wherein the stepped portion is conical for improved thermal and electrical contact.

FIGS. 6*a* and 6*b* take into account the fact that the inner edges of the electrode collar 22 incline toward electrode sputter, particularly when the electrode collar 22 is arranged as cathode and is exposed to the intensive radiation from the plasma 5 due to radiation embrittlement. This phenomenon is countered by edge coating 26 of the front inner edge of the electrode collar 22. For this purpose, the edges of the electrode collar 22 at which the radiation loading and the temperature are greatest are coated with materials with a reduced tendency to sputter, such as $Al_2O_3$, AlN, zirconium-oxygen compounds and silicon-oxygen compounds, or with a diamond coating or an alloy of one of the above-mentioned compounds combined with molybdenum or tungsten. These edge coatings 26 of the electrode collar 22 which were tested in different EUV sources are also applicable in the electrode shapes in FIGS. 5*a*, 5*b* and 7 and are shown in another construction according to FIG. 8.

FIG. 6*b* also differs from FIG. 6*a* in that the base body 25 has two stepped portions 23 on the outer side, wherein the second step 28 tapers conically and accordingly improves the thermal transition to the rest of the electrode housing 2.

The design according to FIG. 7 provides an expansion of the interior space (bore hole) of the electrode collar 22 to reduce ablation of material from the inner wall of the electrode collar 22. The resulting narrowed outlet 21 of the electrode collar 22 which constitutes a widened base area for the gas discharge at the same time is manufactured in its entirety from a material with a high melting temperature. In addition, the inner surface of the electrode collar 22 is lined with a material having a high melting temperature extending over the entire inner surface (bore hole) of the electrode collar 22 in order to further reduce the electrode sputter from this area.

FIG. 8 shows a modification of the design of FIG. 6*a*. In this case, additional channels 27 for the through-flow of working gas are provided in the base body 25 so as to be uniformly distributed around the axis of symmetry 6. These channels 27 serve to compensate for wear of the central outlet 21 at the end of the electrode collar 22 particularly during longer periods of continuous operation of the radiation source, so that the duration of gas discharge without malfunction is substantially prolonged because the required gas flow can take place through the channels 27.

In other possible electrode shapes which are not shown in FIGS. 5 to 8, a plurality of holes can be arranged in a circular shape around the axis of symmetry 6 in order to improve the passage and distribution of the preionization radiation from the second electrode housing 2 in the gas discharge zone in the interior of the first electrode housing 1.

Further, concave or convex surfaces and rounded edge areas such as those indicated by way of example in FIG. 1 are also useful. The same applies to the production of ring-shaped electrodes 12 of the first electrode housing 1.

Figure 4:
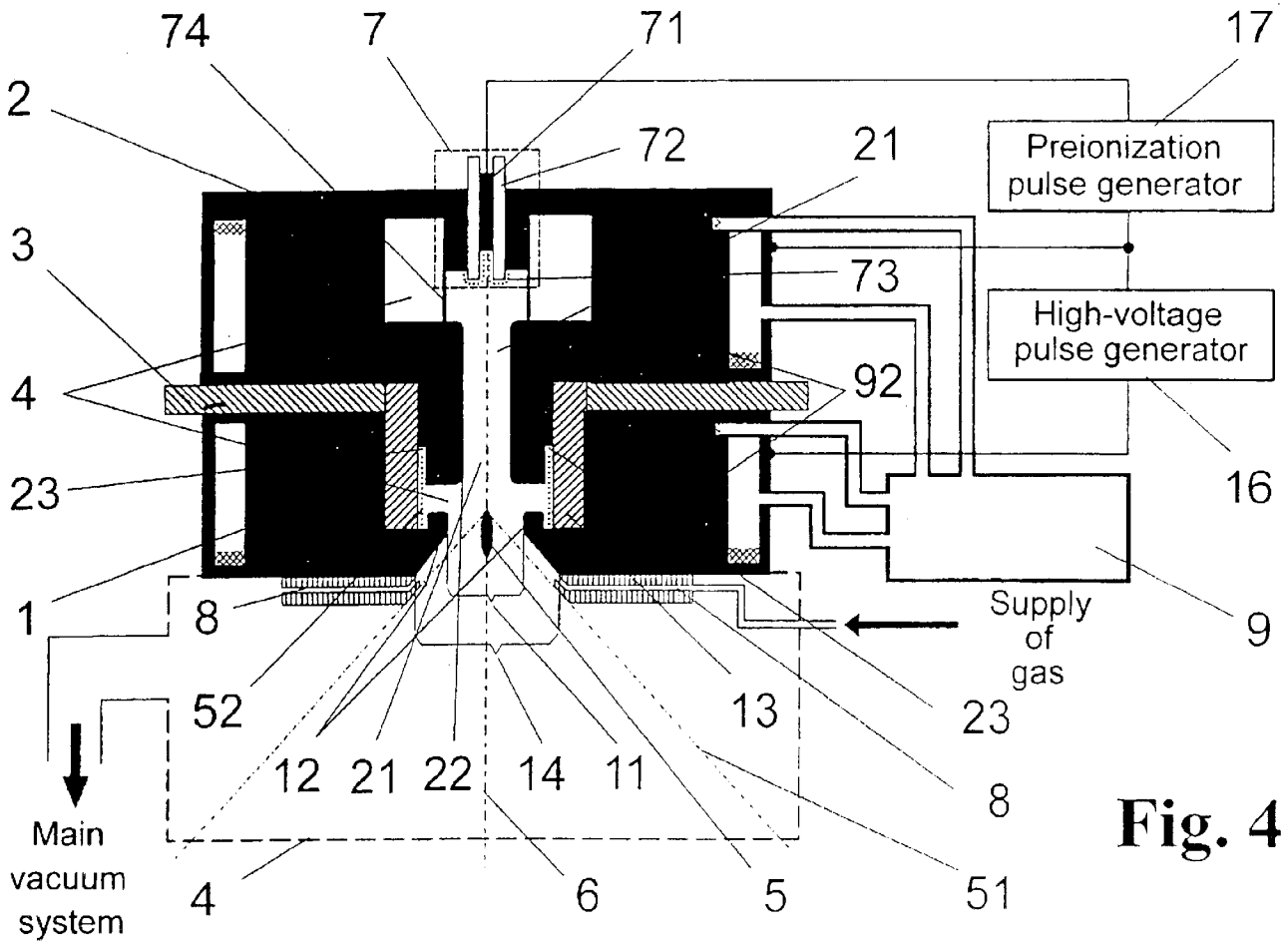
FIG. 4 shows an arrangement of the EUV source in which the working gas is introduced through the gas discharge zone proceeding from the outlet opening.

FIG. 4 shows another construction of the radiation source according to the invention. Like FIG. 2, it has a porous structure 92 as the basis of the heat dissipation system 9. In contrast to FIGS. 1 to 3, the working gas is used in this example as an additional coolant in the discharge zone. For this purpose, a plurality of gas inlets 8 are arranged at the outlet of the first electrode housing 1 so as to be uniformly distributed around the axis of symmetry 6 in such a way that the conical expansion 14 is used as an introduction surface for introducing the working gas into the interior of the first electrode housing 1. The active parts of the ring-shaped conical electrode 12 and of the electrode collar 22 are accordingly additionally cooled over the surface. All the rest of the elements have been retained corresponding to the description according to FIG. 2.

Figure 9:
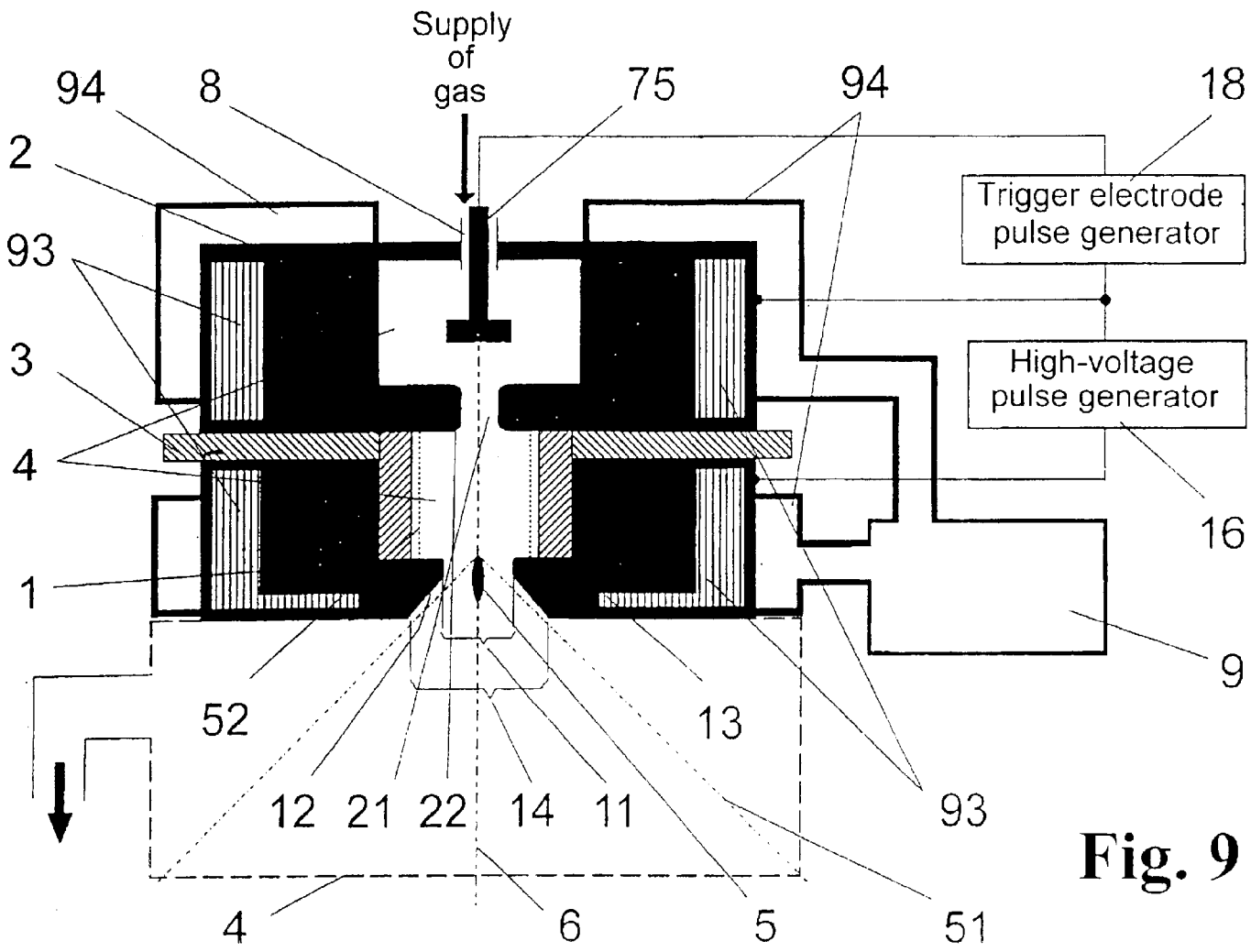
FIG. 9 shows a construction of the invention for an EUV source operated by hollow cathode triggered pinch discharge.

FIG. 9 shows the use of the invention on a radiation source based on a hollow cathode triggered pinch discharge. In this construction, in contrast to the previous constructions with reference to FIGS. 1 to 3, no pronounced electrode collar 22 is necessary. The trigger electrode 74, to which a trigger electrode pulse generator 18 applies a potential several hundred volts higher compared with the second electrode housing 2, prevents the spontaneous development of the gas breakdown by sucking up electrons. All the rest of the basic constructions of the electrode housings 1 and 2 and measures carried out particularly for effective heat dissipation—as shown herein—with a heat pipe system 93 and connected heat exchangers 94 (or alternatively, analogous to FIG. 2, with the porous metal structure in the base body 25 of the electrode housings 1 and 2) are constructed in an analogous manner. Further, the measures for preventing the electrode melting and electrode sputter processes at the loaded inner edges can be applied in the same manner.

The shielding of the side walls of the first electrode housing 1 by the tubular insulator layer 13 and the expansion 14 of the first electrode housing 1 after the outlet opening 12 are realized as effective for the development of the plasma 5 in this case too, so that the plasma 5 in the form of a hot, dense plasma column is shifted from the actual discharge zone via the outlet opening 12 into the expanded portion 14. Accordingly, in this example, the plasma generation also makes use of the principles according to the invention for reduction of electrode wear.

The preceding description is directed to preferred constructions of the invention in which the actual gas discharge takes place in a first electrode housing and a separate second chamber in the interior of a second electrode housing serves for preionization of the working gas and triggering of the gas discharge. For this purpose, various steps were suggested for improved long-term stability of the active electrode parts, all of which should postpone electrode consumption and the resulting short circuiting effects. It will be clear to any person skilled in the art that many different alterations and modifications can be carried out without departing from the protective scope of the invention. For example, different opening ratios of the electrode housings 1 and 2, positions and shapes of the gas inlets 8 for the working gas clearly lie within the protective scope of the present invention as long as the design of the electrode housings for reducing electrode wear and improving heat dissipation is carried out in the same way. These steps can also be carried over in an analogous manner to theta pinch, plasma focus and astron arrangements.

While the foregoing description and drawings represent the present invention, it will be obvious to those skilled in the art that various changes may be made therein without departing from the true spirit and scope of the present invention.

Reference Numbers:

1 first electrode housing
11 outlet opening
12 ring-shaped conical electrode
13 tubular insulator layer
14 conical expansion
16 high-voltage pulse generator
17 preionization pulse generator
18 trigger electrode pulse generator
2 second electrode housing
21 (narrowed) outlet
22 electrode collar
23 step
24 special electrode zone
25 base body
26 edge coating
27 channels
28 second step
3 insulator
4 vacuum chamber
5 plasma

51 emitted radiation
52 initial gas discharge
6 axis of symmetry
7 preionization module
71 electrode
72 insulator tube
73 sliding discharge
74 cylindrical supporting frame
75 trigger electrode
8 gas inlet
9 heat dissipation system
91 ribs
92 porous structure
93 capillary structure
94 heat exchanger

What is claimed is:

1. A radiation source for the generation of extreme ultraviolet (EUV) radiation based on a dense, hot plasma generated by gas discharge containing two electrodes which are electrically separated from one another by insulators which are resistant to breakdown and at the same time form rotationally symmetric electrode housings for parts of a vacuum chamber, comprising:

a vacuum chamber;

a first electrode housing and a second electrode housing provided within the vacuum chamber;

a gas discharge for plasma generation being provided between said first electrode housing and second electrode housing;

an outlet opening for the radiation emitted by the plasma being provided in the first electrode housing;

a gas supply unit for generating a flow of working gas through the vacuum chamber;

a high-voltage module for providing high-voltage pulses at the electrodes;

a preionization unit for generating preionization of the working gas prior to the gas discharge triggered by the high-voltage pulse;

said second electrode housing having a narrowed portion and an electrode collar which adjoins the latter and which is enclosed concentrically by the first electrode housing;

a concentric insulator layer being provided in this area of concentric overlapping between the first electrode housing and the electrode collar of the second electrode housing in order to shield the concentric surface regions of the two electrode housings;

said concentric insulator layer extending in the direction of the outlet opening of the first electrode to the extent that the gas discharge takes place substantially parallel to the axis of symmetry of the electrode housing; and said electrode collar being stepped radially relative to the concentric insulator layer in such a way that at least one end region of the electrode collar is at a distance from the concentric insulator layer such that a concentric gap is formed.

2. The radiation source according to claim 1, wherein the outlet opening in the first electrode housing has the shape of a circular narrowed portion coaxial to the axis of symmetry of the electrode housing and the first electrode housing is expanded conically following the narrowed outlet opening, so that the gas discharge is ignited between the two electrodes in the interior of the first electrode housing and the dense, hot plasma is formed within the conical expansion after the outlet opening of the first electrode housing.

3. The radiation source according to claim 1, wherein the electrode collar of the second electrode housing projecting into the first electrode housing has the shape of a hollow cylinder with a plurality of steps.

4. The radiation source according to claim 3, wherein the electrode collar of the second electrode housing is a hollow cylinder with two outer steps and one inner step, wherein the second outer step forms a transition from the electrode collar to the main portion of the second electrode housing.

5. The radiation source according to claim 3, wherein at least one step of the hollow cylinder has a conical transition.

6. The radiation source according to claim 3, wherein the electrode collar is drilled on the inner side in order to reduce electrode erosion, and wherein a narrowed outlet remains as an enlarged base area for the gas discharge.

7. The radiation source according to claim 1, wherein the electrode housing is made from one of the metals, copper, tungsten, molybdenum or an alloy of these metals in a desired mixture ratio.

8. The radiation source according to claim 7, wherein at least thermally highly loaded zones of the electrode housing, particularly of the electrode collar, are produced from an alloy of tungsten with one of the materials, titanium, tantalum, zirconium, rhenium, lanthanum, lanthanum oxide, nickel, iron, nickel-iron compounds or zirconium-oxygen compounds in a desired mixture ratio.

9. The radiation source according to claim 7, wherein at least thermally highly loaded zones of the electrode housing, particularly of the electrode collar, are produced from an alloy of molybdenum with one of the materials, titanium, tantalum, zirconium, rhenium, lanthanum, lanthanum oxide, nickel, iron, nickel-iron compounds or zirconium-oxygen compounds in a desired mixture ratio.

10. The radiation source according to claim 1, wherein at least zones of the electrode housing upon which the the radiation flow of the plasma or the current flow acts particularly intensively, particularly free inner edges of the electrode collar or of the outlet opening, are coated with a material having a low sputter rate.

11. The radiation source according to claim 10, wherein the highly loaded zones of the electrode housing are coated with aluminum oxide, aluminum nitride, zirconium oxides or silicon oxides.

12. The radiation source according to claim 10, wherein the highly loaded zones of the electrode housing are coated with an alloy of tungsten, molybdenum or rhenium with one of the compounds, aluminum nitride, aluminum oxide, zirconium oxide or silicon oxide.

13. The radiation source according to claim 10, wherein the highly loaded zones of the electrode housing are coated with a tungsten-carbon compound, particularly a tungsten-diamond compound.

14. The radiation source according to claim 1, wherein the first electrode housing is arranged as anode and the second electrode housing is arranged as cathode.

15. The radiation source according to claim 1, wherein the first electrode housing is arranged as cathode and the second electrode housing is arranged as anode.

16. The radiation source according to claim 1, wherein the concentric insulator in the interior of the first electrode housing is an insulator pipe made from one of the compounds, $Si_3N_4$, $Al_2O_3$, AlN, AlZr, AlTi, BeO or lead-zirconium-titanate (PZT).

17. The radiation source according to claim 1, wherein the preionization module is arranged inside the second electrode housing coaxial to the electrode housing and comprises two circular electrodes with a tubular insulator located therebetween, wherein an end surface of the second electrode housing is used as one of the circular electrodes and the surface of the tubular insulator is provided for a sliding discharge for preionization of the working gas.

18. The radiation source according to claim 17, wherein the tubular insulator for the gas discharge is made of one of the materials, $Si_3N_4$, $Al_2O_3$, AlN, AlZr, AlTi, BeO or of highly dielectric materials such as lead-zirconium-titanate (PZT), barium titanate, strontium titanate, lead borosilicate or lead-zinc borosilicate.

19. The radiation source according to claim 17, wherein the preionization module has a gas inlet for the working gas, this gas inlet being guided coaxially through the tubular insulator.

20. The radiation source according to claim 1, wherein the first electrode housing and the second electrode housing are fashioned in such a way that they have a base body comprising material with very good thermal conduction, particularly copper, wherein an efficient heat dissipation system is joined to this base body for efficient elimination of heat from the discharge zone of the electrodes.

21. The radiation source according to claim 20, wherein the heat dissipation system is based upon a porous metal structure.

22. The radiation source according to claim 20, wherein the heat dissipation system is based upon a heat pipe system.

23. The radiation source according to claim 21, wherein water, a low-viscosity oil, e.g., Galden, mercury, sodium or lithium is provided as active coolant.

24. The radiation source according to claim 20, wherein a heat dissipation system is integrated in the base body of each electrode housing.

25. The radiation source according to claim 1, wherein a gas inlet for the working gas is arranged at least in one defined location in the interior of the conical expansion of the first electrode housing, wherein the gas inlet has inlet openings which are evenly distributed around the axis of symmetry.

26. The radiation source according to claim 1, wherein one of the gases, xenon, krypton, argon, neon, nitrogen, oxygen, lithium vapor or iodine vapor, or a mixture of some of the latter is used as working gas.

27. The radiation source according to claim 1, wherein xenon is mixed in a proportion of at least 10% by volume with hydrogen, deuterium, helium or neon.

28. The radiation source according to claim 1, wherein the high-voltage module contains a pulse generator with a repetition frequency between 1 Hz and 20 kHz for igniting the gas discharge.

29. A radiation source for generating extreme ultraviolet (EUV) radiation based on a dense, hot plasma generated by gas discharge, preferably using hollow cathode triggered pinch arrangements, theta pinch arrangements, plasma focus arrangements or astron arrangements, comprising:

a vacuum chamber;

two electrodes which are electrically separated and which at the same time form rotationally symmetric electrode housings for parts of said vacuum chamber;

a gas discharge for plasma generation being provided between the electrode housings inside the vacuum chamber;

an outlet opening for the radiation emitted by the plasma being provided in at least a first electrode housing;

a gas supply unit for generating a flow of working gas through the vacuum chamber;

a high-voltage module for providing high-voltage pulses at the electrodes;

the second electrode housing likewise having a narrowed portion which is coaxially received by the first electrode housing; and each of the electrode housings comprising a base body with very good heat conduction which is connected to an efficient heat dissipation system and electrode zones subject to high thermal loading comprise materials with a high melting point at least at the narrowed portions of the electrode housings.

30. The radiation source according to claim 29, wherein the first electrode housing is coated with an insulator layer at the inner surfaces which coaxially adjoin the narrowed portion of the second electrode housing so as to be electrically insulated, so that the gas discharge is oriented essentially only parallel to the axis of symmetry of the electrode housings.

31. The radiation source according to claim 30, wherein the outlet opening of the first electrode housing is a circular narrowed portion coaxial to the axis of symmetry of the electrode housing and the electrode housing is expanded conically after the outlet opening, so that the gas discharge between the two electrodes is ignited and the dense, hot plasma is formed inside the conical expansion after the outlet opening of the first electrode housing.

32. The radiation source according to claim 29, wherein thermally highly loaded electrode zones comprise tungsten or an alloy of tungsten with one of the materials, molybdenum, titanium, tantalum, zirconium, rhenium, lanthanum, lanthanum oxide, nickel, iron, nickel-iron compounds or zirconium-oxygen compounds in a desired mixture ratio.

33. The radiation source according to claim 29, wherein thermally highly loaded electrode zones comprise molybdenum or an alloy of molybdenum with one of the materials, tungsten, titanium, tantalum, zirconium, rhenium, lanthanum, lanthanum oxide, nickel, iron, nickel-iron compounds or zirconium-oxygen compounds in a desired mixture ratio.

34. The radiation source according to claim 29, wherein highly loaded electrode zones upon which the radiation flow from the plasma or electric current flow acts particularly intensively, particularly the inner edges of the electrodes at the narrowed portions of the electrode housings, are coated with materials having low sputter rates such aluminum oxide, aluminum nitride, zirconium oxides, silicon oxides or an alloy of these compounds with tungsten, molybdenum or rhenium.

35. The radiation source according to claim 34, wherein highly loaded electrode zones upon which the radiation flow from the plasma or electric current flow acts particularly intensively, particularly the inner edges of the electrodes at the narrowed portions of the electrode housings, are coated with tungsten-carbon compounds.

36. The radiation source according to claim 29, wherein the heat dissipation system in the base bodies of the electrode housings contains a porous metal structure or heat pipe system.

37. The radiation source according to claim 29, wherein the heat dissipation system has cooling channels for an inner electrode, wherein the cooling channels through the outer electrode housing are provided for cooling the inner electrode based on a porous metal structure or a heat pipe system.

* * * * *